United States Patent [19]

Lodrick, Sr.

[11] Patent Number: 5,052,968

[45] Date of Patent: Oct. 1, 1991

[54] MAGNETICALLY ACTUATED AMUSEMENT DEVICE

[76] Inventor: Lawrence E. Lodrick, Sr., 2436 Harrison Ave., North, Rochester, Mich. 48063

[21] Appl. No.: 63,003

[22] Filed: Jun. 17, 1987

Related U.S. Application Data

[63] Continuation-in-part of Ser. No. 740,328, Jun. 3, 1985, Pat. No. 4,690,657.

[51] Int. Cl.[5] ..... A63H 33/26

[52] U.S. Cl. ..... 416/134

[58] Field of Search ..... 446/134, 133, 135, 136, 446/132, 131, 129; 273/1 M, 141 A; 40/426

[56] References Cited

U.S. PATENT DOCUMENTS

| | | | |
|---|---|---|---|
| 1,257,045 | 2/1918 | Stotler . | |
| 2,220,049 | 10/1940 | Dunmore . | |
| 2,669,800 | 2/1954 | Dietrich | 446/129 |
| 3,196,566 | 7/1965 | Littlefield | 40/106.3 |
| 3,235,260 | 2/1966 | Glass et al. | 273/141 |
| 3,478,466 | 11/1969 | Conner . | |
| 3,707,290 | 12/1972 | Birnkrant | 446/129 X |
| 4,011,674 | 3/1977 | Jacobson | 40/39 |
| 4,178,707 | 12/1979 | Lihlefield | 446/129 X |
| 4,211,414 | 7/1980 | Moodt | 273/141 A |
| 4,250,659 | 2/1981 | Ishiguro | 446/133 |
| 4,432,544 | 2/1984 | Wakimura | 273/1 M |
| 4,568,301 | 2/1986 | Hawley, Jr. | 446/134 |
| 4,690,657 | 9/1987 | Loderick, Sr. | 446/134 |

FOREIGN PATENT DOCUMENTS 2339351 3/1975 Fed. Rep. of Germany .

*Primary Examiner*—Mickey Yu

*Attorney, Agent, or Firm*—Basile and Hanlon

[57] ABSTRACT

A magnetically actuated amusement device comprising a flat magnet of vertically oriented polarity and a bar magnet of longitudinally oriented polarity; the flat magnet is contained in a base and the bar magnet is suspended above the center of the base by a flexible tether. The tether is attached to the end of the bar magnet having a pole of unlike polarity to the upper most pole of the flat magnet within the base. The other end of the bar magnet is left free to be cantilevered up to a position where it is approximately as high as the tethered end by the strengths of the repulsive forces between the magnets.

4 Claims, 1 Drawing Sheet

MAGNETICALLY ACTUATED AMUSEMENT DEVICE

REFERENCE TO RELATED APPLICATION

The above referenced application is a continuation in part of my application Ser. No. 740,328, filed June 3, 1985, now U.S. Pat. No. 4,690,657.

BACKGROUND OF THE INVENTION

1. Field of the Invention

This invention relates to amusement devices and particularly to those employing magnetic fields to create amusing effects by suspending a figure having therein a longitudinally polarized magnetic in cantilevered fashion over a base containing a flat magnet.

2. Description of the Prior Art

A variety of magnetically actuated amusement devices are known. For example, U.S. Pat. No. 4,250,659 discloses a toy figure having a magnet affixed thereto with substantially vertical polar alignment, said toy figure being supported above a base having a magnet therein also of substantially vertical polar alignment. The toy figure is supported above the base by a support means including a rigid portion and a flexible portion. The two magnets are orientated with like poles closest together. The center of gravity of the toy lies off axis to the magnet forces between a magnet. When the support means is displaced, the figure will appear to skip and dance above the base. However, both the figure and the magnet therein remain substantially vertically orientated.

While not strictly an amusement device, the invention disclosed and claimed in U.S. Pat. No. 4,178,707 also discloses employing a base magnet having substantially vertical polar orientation and an object suspended thereabove by a tether, said object having a magnet contained therein. However, the polar orientation of the magnet contained in the object is longitudinal. By offsetting the base magnet with respect to the point of attachment of the tether, the object is held in a more or less fixed position with the pole of like polarity suspended above the base magnet. The repulsive forces between the like poles in the object and base magnets are claimed to suspend the object above the base magnet. The other pole of the magnet inside the object does not overlie the base magnet. In order for the object to be held in a "floating" position, it is necessary that the tether between the objects and its means of support be rigid or the end of the object carrying the like pole will simply flip over.

In my above referenced application Ser. No. 740,328, I disclose a magnetically actuated amusement device wherein the magnet contained within the base is randomly repositional therein. An object such as a pointer is pendulously suspended above the base. The orientation of the magnets contained in the base and in the pointer are such that the unsupported end of the pointer will be cantilevered into a position where it is at least as high as the supported end. By randomly repositioning the magnet within the base, the suspended pointer will be repositioned in a random and unpredictable manner.

However, it has been found that other amusing effects can be obtained by forming the base such that the flat magnet contained therein of vertically disposed polarity is rigidly fixed in the base. At least one object containing a magnet of longitudinally disposed polarity is suspended with its point of suspension centered above the base. Rather than having to reposition the magnet in the base, as is the case in my above referenced application Ser. No. 740,328, it is possible to cause amusing gyrations of the suspended object by simply moving the object or the tether which attaches it to the point of suspension. By selecting the weight of the object and the magnetic strength of the base magnet, it is possible to suspend the object such that it is oriented in a cantilevered fashion, with its free end approximately as high as its tethered end.

Thus, it would be desirable to provide a magnetically actuated amusement device wherein an object is freely suspended above the center of a base, the object containing a magnet of longitudinally orientated polarity and the base a fixed magnet of vertically orientated polarity, such that the free end of the object is of like polarity to the upper pole of the base of the magnet within the base, so as to cause a cantilevered effect.

It would also be desireable to provide a device with a plurality of such suspended objects so as to create further amusing effects due to the interaction of all of the magnets.

SUMMARY OF THE INVENTION

Disclosed and claimed herein is an amusement device which comprises a base having a geometric center. A flat magnet of vertically orientated polarity is fixedly disposed around the center of the base with one pole of the magnet entirely overlaying the other. An object containing a magnet of longitudinally oriented polarity is pendulously and freely supported above the center of the base by a flexible tether attached to the pole of the magnet within the object which is opposite in polarity to the uppermost pole of the flat magnet. The other pole is left free. The strength of the magnetic field generated by the flat magnet is selected to be sufficiently strong in relation to the weight of the object such as to cause the free end of the object to be cantilevered up to an orientation where it is approximately as high as the tethered end.

In another embodiment of the herein disclosed invention, a plurality of objects are suspended above the base in the manner described above. Each of the plurality of objects contains a magnet of longitudinally orientated polarity.

To actuate the device, either the suspended object or the tether is displaced from its normal, equilibrium position. This displacement will cause the object to be displaced from the equilibrium position, thereby causing it to gyrate and swing in an amusing manner. If a plurality of objects is provided, displacement in the manner described of one or both of the objects will cause amusing and interactive effects between the two objects. Thus, one object will appear to be "chasing" the other as they gyrate toward their equilibrium positions.

BRIEF DESCRIPTION OF THE DRAWINGS

In the drawings, like reference numbers refer to like parts throughout the several views, wherein.

DESCRIPTION OF THE PREFERRED EMBODIMENT

Figure 1:
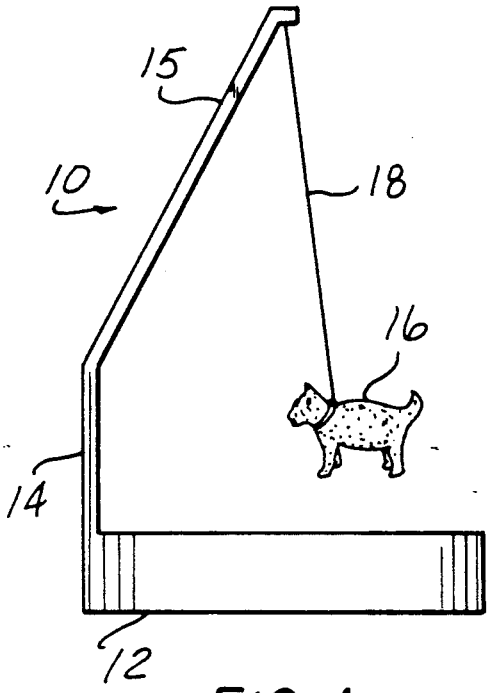
FIG. 1 is a side elevational view of the present invention.
Figure 2:
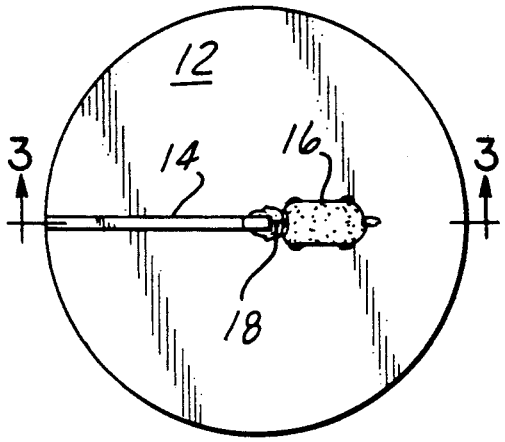
FIG. 2 is a plan elevational view of the said device of the present invention.
Figure 3:
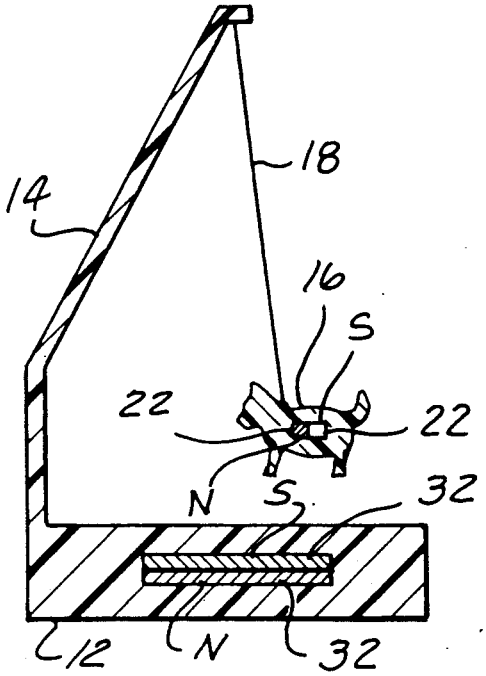
FIG. 3 is a cross sectional view taken along the line 3—3 of FIG. 2.

Referring now to the drawing, there is illustrated in FIG. 1 an amusement device 10 made according to the teachings of the present invention. The amusement device 10 has a base 12 which (as seen in FIG. 3) contains a fixed, flat magnet 32. A non-magnetic support arm 14 is perpendicularly attached, to the base 12. The non-magnetic support arm 14 is attached to the periphery of the base 12 and extends perpendicularly upward therefrom for a distance to allow clearance for a toy FIG. 16 which is suspended from a flexible tether means 18 attached to support arm 14. An angled extension 15 of support arm 14 permits support arm 14 to terminate at a point centrally disposed above the base. The flexible tether 18 is attached to toy FIG. 16 at a position thereon approximate to one of the poles (for example the North pole) of a bar magnet 22 contained inside toy FIG. 16, as may be seen by referring to FIG. 3. Toy FIG. 16 may then swing freely and twist around tether means 18. In the preferred embodiment, tether means 18 may be made of any suitable fiber or string.

Flat magnet 32 is oriented with its north-south poles disposed vertically. As can be seen in FIG. 3, the south pole of flat magnet 32 completely overlies the north pole. The flat magnet 12 may comprise, for example, a washer magnet or a round or square magnet of planar configuration. The particular shape of the magnet used for the flat magnet 32 is immaterial so long as it is of flat, planar configuration and has its poles vertically oriented.

Since flat magnet 32 is oriented in base 12 with its south pole uppermost, it will attract the tethered north pole end of bar magnet 22 and repel the free south pole end thereof. However, because bar magnet 22 is tethered at its north pole end, bar magnet 22 and toy FIG. 16 in which it is contained will not be able to be displaced toward base 12. Since the south pole end of the bar magnet 22 is untethered, the repulsive forces between it and the uppermost south pole of flat magnet 32 will be free to act. Hence, if flat magnet 32 is of sufficient strength relative to the weight of toy FIG. 16, the free end of toy FIG. 16 which corresponds to the south pole end of bar magnet 22 will be forced upward by the repulsive forces away from base 12. Toy FIG. 16 will assume a horizontal or slightly inclined position, with the south pole end thereof cantilevered upward.

Movement of tether means 18 or toy FIG. 16 will affect the radial orientation of toy FIG. 16. When tether 18 is swung or toy FIG. 16 otherwise displaced, toy FIG. 16 will be displaced from its equilibrium position and will appear to gyrate erratically around the geometric center of base 12 over which it is suspended. It will always come to rest with its tethered end closest to the center of base 12, and the free end oriented radially outward. A variety of random positions around the center of base 12 will be achieved depending on, among other factors, the inclination thereof with respect to the horizontal. In the preferred embodiment, toy FIG. 16 and magnet means 32 are positioned at a distance so as to optimize the cantilevered effect. That is, tether means 18 supports toy FIG. 16 at a distance above base 12 such that the tethered end of FIG. 16 does not touch base 12 and the free end is close enough thereto to maximize the repulsive forces between the like poles.

Figure 4:
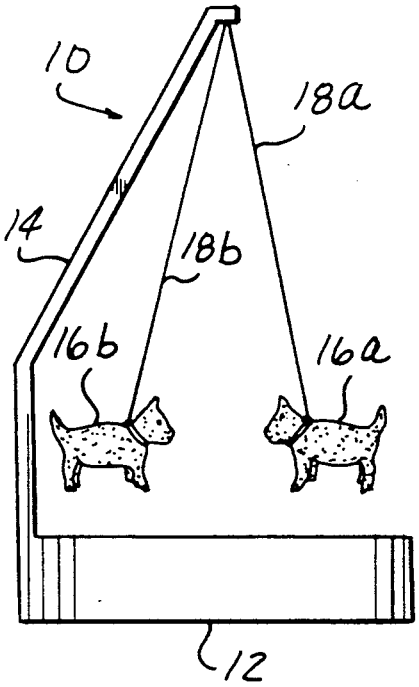
FIG. 4 is a side elevational view of an alternative embodiment of the device of the present invention.

In an alternative embodiment shown in FIG. 4, two toy FIGS. 16*a* and 16*b* are suspended above base 12 by corresponding separate tethers 18*a* and 18*b*, in the cantilevered manner described above. Because three magnets are involved in the interaction, displacement of either or both FIGS. 18*a* and 18*b* will cause complex interactive effects in the resulting movements thereof. Thus, the figures will appear to chase each other around in their erratic gyrations.

It is critical to the above described invention that the weight of FIG. 16, 16*a* and 16*b* not be too great, or the cantilever effect will not be achieved. If the figure is so heavy that the untethered end will not be cantilevered approximately as high as the tethered end, the figures will assume a vertical rather than a more or less horizontal orientation. The amusing effects which are the object of the invention will not be achieved by a vertically displaced figure and the more or less horizonal orientation caused by the cantilever effect will be absent.

Other arrangements and configurations of the various elements described herein may occur to one skilled in the art. The scope of the invention is limited solely by the claims appended hereto.

What is claimed is:

1. An amusement device comprising:

a base having a center;

a flat magnet of vertically oriented polarity disposed around the center of the base with one pole thereof entirely overlying the other; and an object having disposed therein a magnet of longitudinal polarity, said object being pendulously and freely supported above the center of the base by a flexible tether attached to an end of the object adjacent the pole of the magnet therein opposite in polarity to the one uppermost pole of the flat magnet, another end of the object adjacent the other pole of the magnet being left free;

wherein the strength of the magnetic field generated by the flat magnet is sufficiently strong to cause the free end of the object to be cantilevered up to a horizontal orientation where it is approximately as high as the tethered end.

2. The amusement device of claim 1 further comprising a plurality of pendulously supported objects each having a magnet disposed therein of longitudinally disposed polarity and each being supported above the center of the base by a flexible tether attached to the end of the object corresponding to the pole of the magnet therein opposite in polarity to the one uppermost pole of the flat magnet.

3. The amusement device of claim 1 further comprising a support arm having a first and second end, the first end being connected to the periphery of the base such that the support arm extends upward and angularly therefrom, the second end of the support arm being disposed above the center of the base, wherein the tether is attached to the second end.

4. An amusement device comprising:

a base having a center;

a flat magnet of vertically oriented polarity disposed around the center of the base with one pole thereof entirely overlying the other;

two pendulously supported objects, each object having a magnet disposed therein of longitudinally disposed polarity supported above the center of the base by a flexible tether attached to one end of the object adjacent a pole of the magnet disposed therein opposite in polarity to the one uppermost pole of the flat magnet disposed in the base, another end of each object adjacent the other pole of the magnet disposed therein being left free wherein the strength of the magnetic field generated by the flat magnet is sufficiently strong to cause the free end of each object to be cantilevered up to a horizontal orientation where it is approximately as high as the tethered end; and a support arm having a first and second end, the first end being connected to the periphery of the base such that the support arm extends upward and angularly therefrom, the second end of the support arm being disposed above the center of the base, wherein each tether is attached to the second end.

* * * * *